US007014424B2

(12) United States Patent
Cunha et al.

(10) Patent No.: US 7,014,424 B2
(45) Date of Patent: Mar. 21, 2006

(54) TURBINE ELEMENT

(75) Inventors: Frank J. Cunha, Avon, CT (US); Matthew T. Dahmer, Auburn, MA (US)

(73) Assignee: United Technologies Corporation, Hartford, CT (US)

( * ) Notice: Subject to any disclaimer, the term of this patent is extended or adjusted under 35 U.S.C. 154(b) by 248 days.

(21) Appl. No.: 10/409,521

(22) Filed: Apr. 8, 2003

(65) Prior Publication Data

US 2004/0202542 A1 Oct. 14, 2004

(51) Int. Cl.
*B63H 1/14* (2006.01)

(52) U.S. Cl. ..... 416/97 R; 415/115; 415/116

(58) Field of Classification Search ..... 416/97 R, 416/97 A; 415/115, 116
See application file for complete search history.

(56) References Cited

U.S. PATENT DOCUMENTS

| | | | | |
|---|---|---|---|---|
| 3,596,703 | A * | 8/1971 | Bishop et al. | 164/132 |
| 5,243,759 | A * | 9/1993 | Brown et al. | 29/889.721 |
| 5,813,836 | A | 9/1998 | Starkweather | |
| 5,820,774 | A * | 10/1998 | Dietrich | 249/61 |
| 6,234,754 | B1 * | 5/2001 | Zelesky et al. | 416/97 R |
| 6,257,831 | B1 * | 7/2001 | Papple et al. | 416/97 R |
| 6,402,470 | B1 | 6/2002 | Kvasnak et al. | |

* cited by examiner

*Primary Examiner*—Hoang Nguyen
(74) *Attorney, Agent, or Firm*—Bachman & LaPointe, P.C.

(57) ABSTRACT

A turbine element airfoil has a cooling passageway network with a slot extending from a trailing passageway toward the trailing edge. A number of discrete posts span the slot between pressure and suction sidewall portions.

34 Claims, 6 Drawing Sheets

TURBINE ELEMENT

U.S. GOVERNMENT RIGHTS

The government may have rights in this invention, pursuant to Contract Number F33615-02-C-2202, awarded by the United States Air Force, Wright Patterson Air Force Base.

BACKGROUND OF THE INVENTION (1) Field of the Invention

This invention relates to gas turbine engines, and more particularly to cooled turbine elements (e.g., blades and vanes).

(2) Description of the Related Art

Efficiency is limited by turbine element thermal performance. Air from the engine's compressor bypasses the combustor and cools the elements, allowing them to be exposed to temperatures well in excess of the melting point of the element's alloy substrate. The cooling bypass represents a loss and it is therefore desirable to use as little air as possible. Trailing edge cooling of the element's airfoil is particularly significant. Aerodynamically, it is desirable that the trailing edge portion be thin and have a low wedge angle to minimize shock losses.

In one common method of manufacture, the main passageways of a cooling network within the element airfoil are formed utilizing a sacrificial core during the element casting process. The airfoil surface may be provided with holes communicating with the network. Some or all of these holes may be drilled. These may include film holes on pressure and suction side surfaces and holes along or near the trailing edge.

BRIEF SUMMARY OF THE INVENTION

Accordingly, one aspect of the invention is a turbine element having a platform and an airfoil. The airfoil extends along a length from a first end of the platform to a second end. The airfoil has leading and trailing edges and pressure and suction sides. The airfoil has a cooling passageway network including a trailing passageway and a slot extending from the trailing passageway toward the trailing edge. The slot locally separates pressure and suction sidewall portions of the airfoil and has opposed first and second slot surfaces. A number of discrete posts span the slot between the pressure and suction sidewall portions.

In various implementations, the posts may have dimensions along the slot no greater than 0.10 inch. The second end may be a free tip. The posts may include a leading group of posts, a first metering row of posts trailing the leading group, a second metering row of posts trailing the first metering row, and at least one intervening group between the first and second metering rows. The first metering row may have a restriction factor greater than that of the leading group. The second metering row may have a restriction factor greater than that of the leading group. The intervening group may have a restriction factor less than the restriction factors of the first and second metering rows. The posts may include a trailing array of posts spaced ahead of an outlet of the slot. The blade may consist essentially of a nickel alloy. The exact trailing edge of the airfoil may fall along an outlet of the slot. The posts may be arranged with a leading group of a number of rows of essentially circular posts, a trailing row of essentially circular posts, and intervening rows of posts having sections elongate in the direction of their associated rows. The posts may have dimensions along the slot no greater than 0.10 inch.

Another aspect of the invention is a turbine element-forming core assembly including a ceramic element and a refractory metal sheet. The ceramic element has portions for at least partially defining associated legs of a conduit network within the turbine element. The refractory metal sheet is secured to the ceramic element positioned extending aft of a trailing one of the portions. The sheet has apertures extending between opposed first and second surfaces for forming associated posts between pressure and suction side portions of an airfoil of the turbine element.

In various implementations there may be at least one row of circular apertures and at least one row of apertures elongate substantially in the direction of their row. There may be plural such rows of elongate apertures. The elongate apertures may be substantially rectangular. The rows may be arcuate. The rows may be arranged with a first subgroup of rows having apertures having a characteristic with and a greater characteristic separation and a first metering row trailing the first subgroup having a characteristic with and a lesser characteristic separation. The assembly may be combined with a mold wherein pressure and suction side meeting locations of the mold and the sheet fall along essentially unapertured portions of the sheet.

Another aspect of the invention is directed to manufacturing a turbine blade. A ceramic core and apertured refractory metal sheet are assembled. A mold is formed around the core and sheet. The mold has surfaces defining a blade platform and an airfoil extending from a root at the platform to a tip. The assembled core and sheet have surfaces for forming a cooling passageway network through the airfoil. A molten alloy is introduced to the mold and is allowed to solidify to initially form the blade. The mold is removed. The assembled core and refractory metal sheet is destructively removed. A number of holes may then be drilled in the blade for further forming the cooling passageway network. Holes may be laser drilled in the sheet prior to assembling it with the core.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
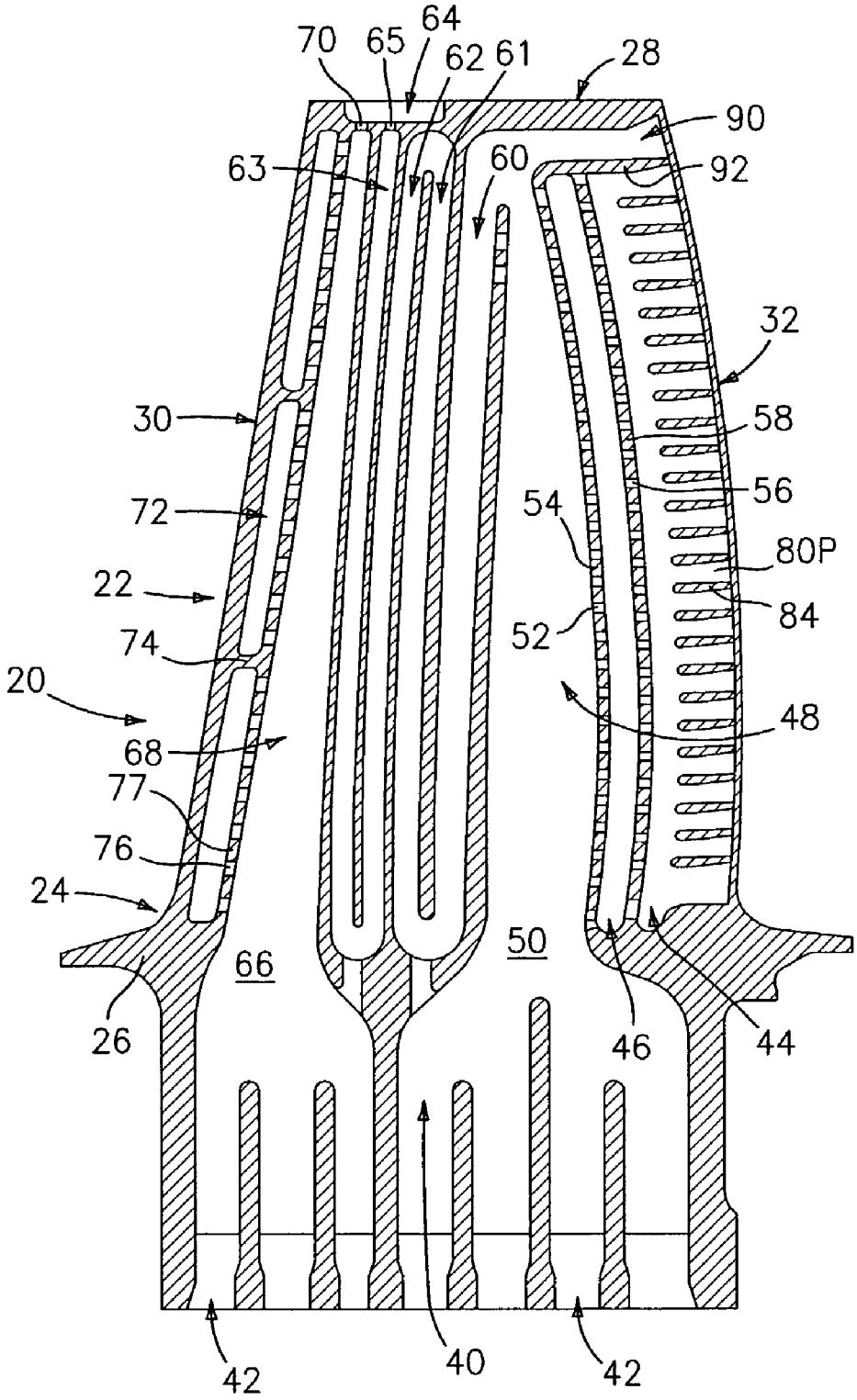
FIG. 1 (PRIOR ART)
FIG. 1 is a mean sectional view of a prior art blade.

FIG. 1 shows a prior turbine blade 20 having an airfoil 22 extending along a length from a proximal root 24 at an inboard platform 26 to a distal end 28 defining a blade tip. A number of such blades may be assembled side by side with their respective platforms forming an inboard ring bounding an inboard portion of a flow path. In an exemplary embodiment, the blade is unitarily formed of a metal alloy.

Figure 2:
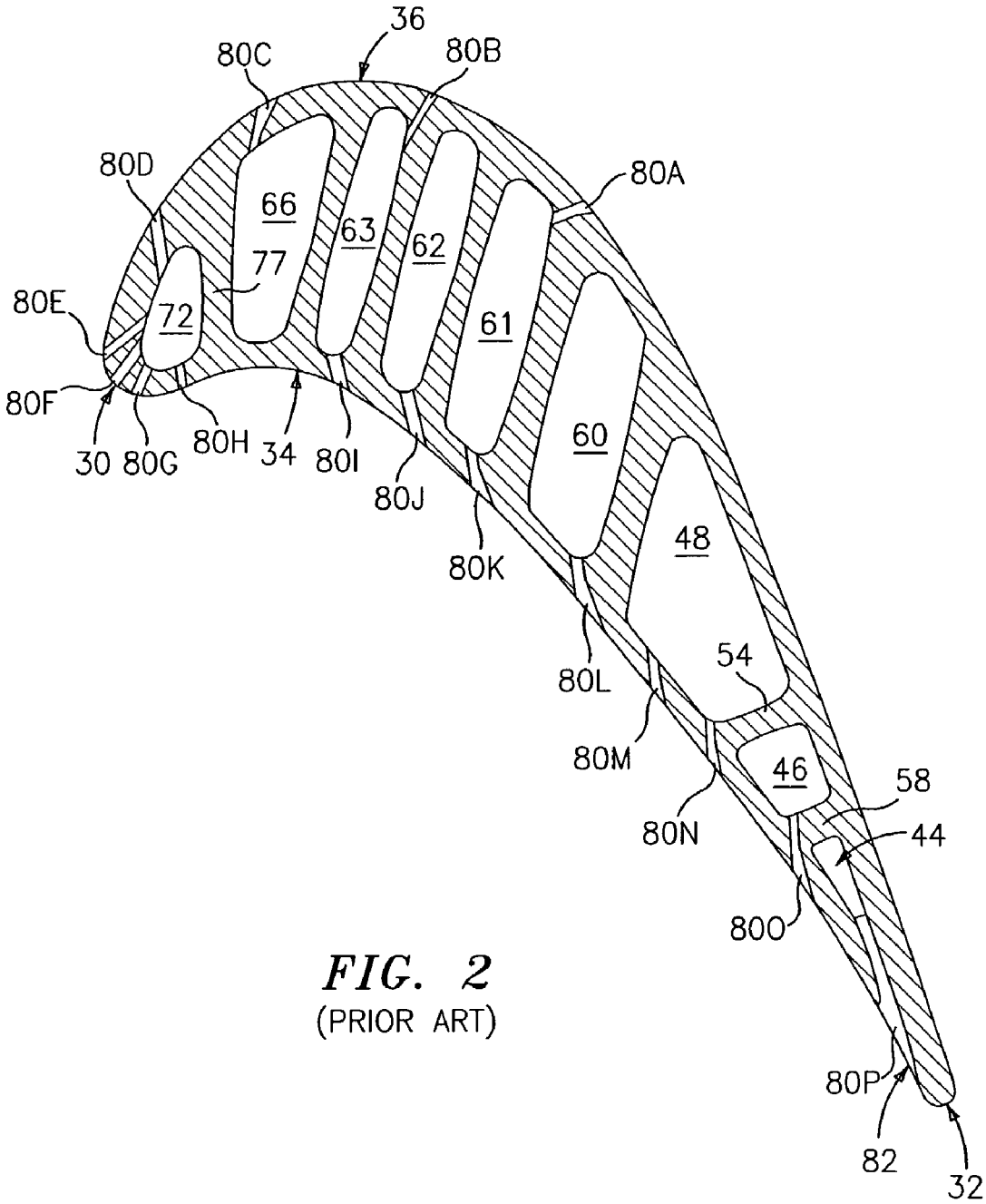
FIG. 2 (PRIOR ART)
FIG. 2 is a sectional view of an airfoil of the blade of FIG. 1.

The airfoil extends from a leading edge 30 to a trailing edge 32. The leading and trailing edges separate pressure and suction sides or surfaces 34 and 36 (FIG. 2). For cooling the airfoil, the airfoil is provided with a cooling passageway network 40 (FIG. 1) coupled to ports 42 in the platform. The exemplary passageway network includes a series of cavities extending generally lengthwise along the airfoil. An aftmost cavity is identified as a trailing edge cavity 44 extending generally parallel to the trailing edge 32. A penultimate cavity 46 is located ahead of the trailing edge cavity 32. In the illustrated embodiment, the cavities 44 and 46 are impingement cavities. The penultimate cavity 46 receives air from a trunk portion 48 of a supply cavity 50 through an array of apertures 52 in the wall 54 separating the two. The supply cavity 50 receives air from a trailing group of the ports in the platform. Likewise, the trailing edge cavity 44 receives air from the penultimate cavity 46 via apertures 56 in the wall 58 between the two. Downstream of the trunk 48, the supply cavity has a series of serpentine legs 60, 61, 62, and 63. The final leg 63 has a distal end vented to a tip or pocket 64 by an aperture 65. The exemplary blade further includes a forward supply cavity 66 receiving air from a leading group of the ports in the platform. The exemplary forward supply cavity 66 has only a trunk 68 extending from the platform toward the tip and having a distal end portion vented to the tip pocket 64 by an aperture 70. A leading edge cavity 72 has three isolated segments extending end-to-end inboard of the leading edge and separated from each other by walls 74. The leading edge cavity 72 receives air from the trunk 68 through an array of apertures 76 in a wall 77 separating the two.

The blade may further include holes 80A–80P (FIG. 2) extending from the passageway network 40 to the pressure and suction surfaces 34 and 36 for further cooling and insulating the surfaces from high external temperatures. Among these holes, an array of trailing edge holes 80P extend between a location proximate the trailing edge and an aft extremity of the trailing edge impingement cavity 44. The illustrated holes 80P have outlets 82 along the pressure side surface just slightly ahead of the trailing edge 32. The illustrated holes 80P are formed as slots separated by islands 84 (FIG. 1).

In the exemplary blade, air passes through the cavities 46 and 44 from the trunk 48 by impinging on the walls 54 and 58 in sequence. Thus, the cavities 46 and 44 are identified as impingement cavities. This air exits the cavity 44 via the slots 80P. Additional air is vented through a trailing edge tip slot 90 (FIG. 1) fed from the distal end of the trunk 48 and separated from the cavities 46 and 44 by a wall 92.

The blade may be manufactured by casting with a sacrificial core. In an exemplary process, the core comprises a ceramic piece or combination of pieces forming a positive of the cooling passageway network including the cavities, tip pocket, various connecting apertures and the holes 80P, but exclusive of the film holes 80A–80O. The core may be placed in a permanent mold having a basic shape of the blade and wax or other sacrificial material may be introduced to form a plug of the blade. The mold is removed and a ceramic coating applied to the exterior of the plug. The ceramic coating forms a sacrificial mold. Molten metal may be introduced to displace the wax. After cooling, the sacrificial mold and core may be removed (such as by chemical leaching). Further machining and finishing steps may include the drilling of the holes 80A–80O. A vane (e.g., having platforms at both ends of an airfoil) may be similarly formed.

Figure 3A:
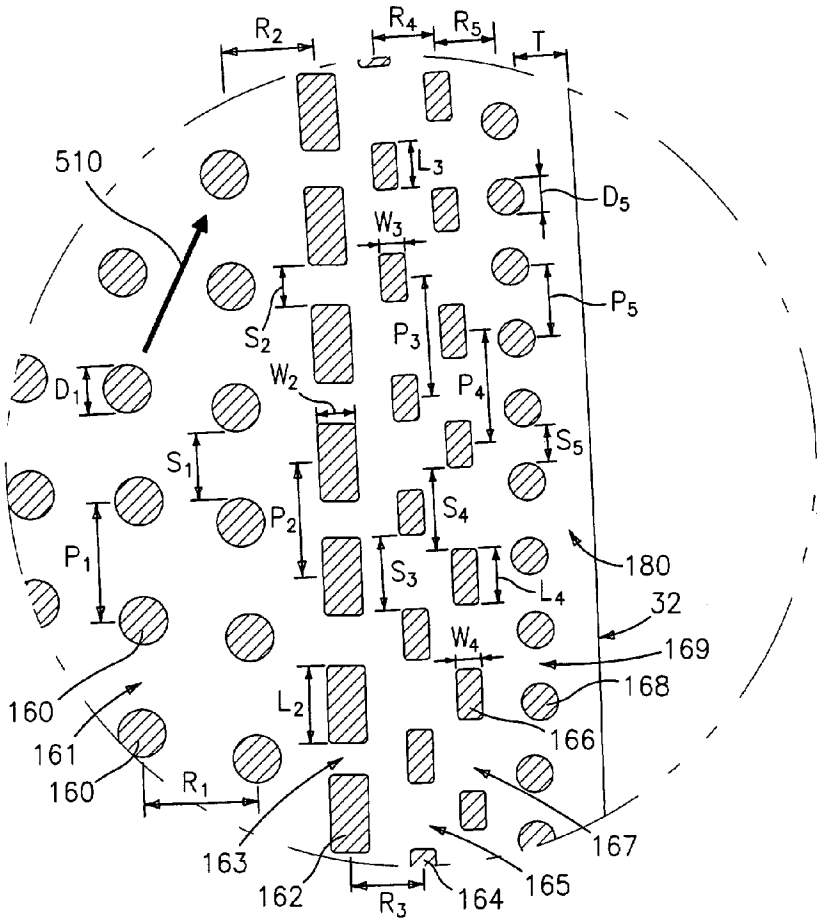
FIG. 3 is a mean sectional view of a blade according to principles of the invention.
Figure 3:
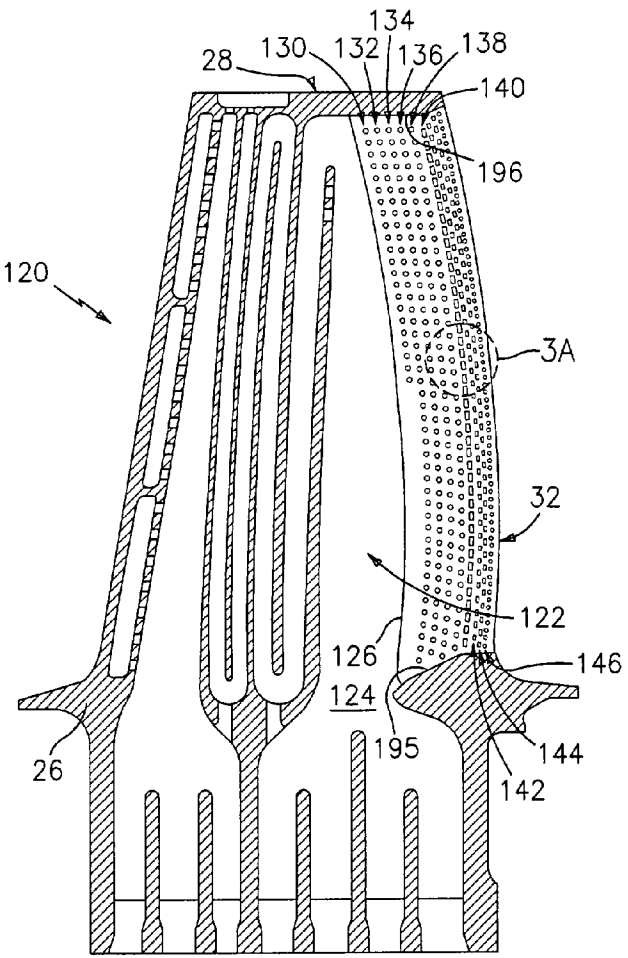

FIG. 3 shows a blade 120 according to the present invention. For purposes of illustration, the blade is shown as an exemplary relatively minimally reengineered modification of the blade 20 of FIG. 1. In this reengineering, external dimensions of the blade remain generally the same. Additionally, internal features of the blade ahead of the trunk 122 of the trailing supply cavity 124 are identical and are identified with identical numerals. Notwithstanding the foregoing, alternate reengineering might make further changes. Aft of a rear extremity 126 of the trunk 122, and without an intervening wall, are a number of rows 130, 132, 134, 136, 138, 140, 142, 144, and 146 of posts or pedestals. In the exemplary embodiment, the rows are slightly arcuate, corresponding to the arc of the trailing edge 32. In an exemplary embodiment, the leading row 130 extends only along a distal portion (e.g., about one half) of the length of the airfoil. The remaining rows extend largely all the way from the root to adjacent the tip. In the exemplary embodiment, the leading group of five rows 130–138 have pedestals 160 formed substantially as right circular cylinders and having interspersed gaps 161. The pedestals 160 have a first diameter $D_1$ with a first on center spacing or pitch $P_1$ and a first separation $S_1$ wherein $S_1=P_1-D_1$. $D_1$ is thus a characteristic dimension of the pedestals 160 both along the centerline of the associated row and transverse thereto. A row pitch or centerline-to-centerline spacing $R_1$ is slightly smaller than $P_1$ and slightly larger than $S_1$. The rows have their phases slightly staggered. The slight stagger is provided so that adjacent pedestals are approximately out of phase when viewed along an approximate overall flow direction 510 which reflects influence of centrifugal action.

The next row 140 has pedestals 162 formed substantially as rounded right rectangular cylinders. The pedestals 162 have a length $L_2$ (measured parallel to the row), a width $W_2$ (measured perpendicular to the row), a pitch $P_2$, and a separation $S_2$. In the exemplary embodiment, the pitch is substantially the same as $P_1$ and the pedestals 162 are exactly out of phase with the pedestals 160 of the last row 138 in the leading group. This places the leading group last row pedestals directly in front of gaps 163 between the pedestals 162. A row pitch $R_2$ between the row 140 and the row 138 is slightly smaller than $R_1$. The next row 142 has pedestals 164 also formed substantially as rounded right rectangular cylinders. The pedestals of this row have length, width, pitch, and separation $L_3$, $W_3$, $P_3$, and $S_3$. In the exemplary embodiment, $L_3$, and $W_3$ are both substantially smaller than $L_2$ and $W_2$. The pitch $P_3$, however, is substantially the same as $P_1$ and the stagger also completely out of phase so that the pedestals 164 are directly behind associated gaps 163 and gaps 165 between the pedestals 164 are directly behind associated pedestals 162. A row pitch $R_3$ between the row 142 and the row 140 thereahead is somewhat smaller than $R_2$ and $R_1$. The next row 144 has pedestals 166 also formed substantially as rounded right rectangular cylinders. The pedestals 166 have length, width, pitch, and spacing $L_4$, $W_4$, $P_4$, and $S_4$. In the exemplary embodiment, these are substantially the same as corresponding dimensions of the row 142 thereahead, but completely out of phase so that each pedestal 166 is immediately behind a gap 165 and each gap 167 is immediately behind a pedestal 164. A row pitch $R_4$ between the row 144 and the row 142 thereahead is, like $R_3$, substantially smaller than $R_2$ and $R_1$. In the exemplary embodiment, the trailing row 146 has pedestals 168 formed substantially as right circular cylinders of diameter $D_5$, pitch $P_5$, and spacing $S_5$ of gaps 169 therebetween. In the exemplary embodiment, $D_5$ is smaller than $D_1$ and the rectangular pedestal lengths. Additionally, the pitch $P_5$ is smaller than pitches of the other rows and separation $S_5$ is smaller than the separations of the rows other than the row 140. A row pitch $R_5$ between the row 146 and the row 144 thereahead is, like $R_3$ and $R_4$, substantially smaller than $R_1$ and $R_2$. In the exemplary embodiment, the centerline of the row 146 is sufficiently forward of the trailing edge 32 that there is a gap 180 between the trailing extremity of each pedestal 168 and the trailing edge 32. The exemplary gap has a thickness T approximately 100% to 200% of the diameter $D_5$.

Figure 4:
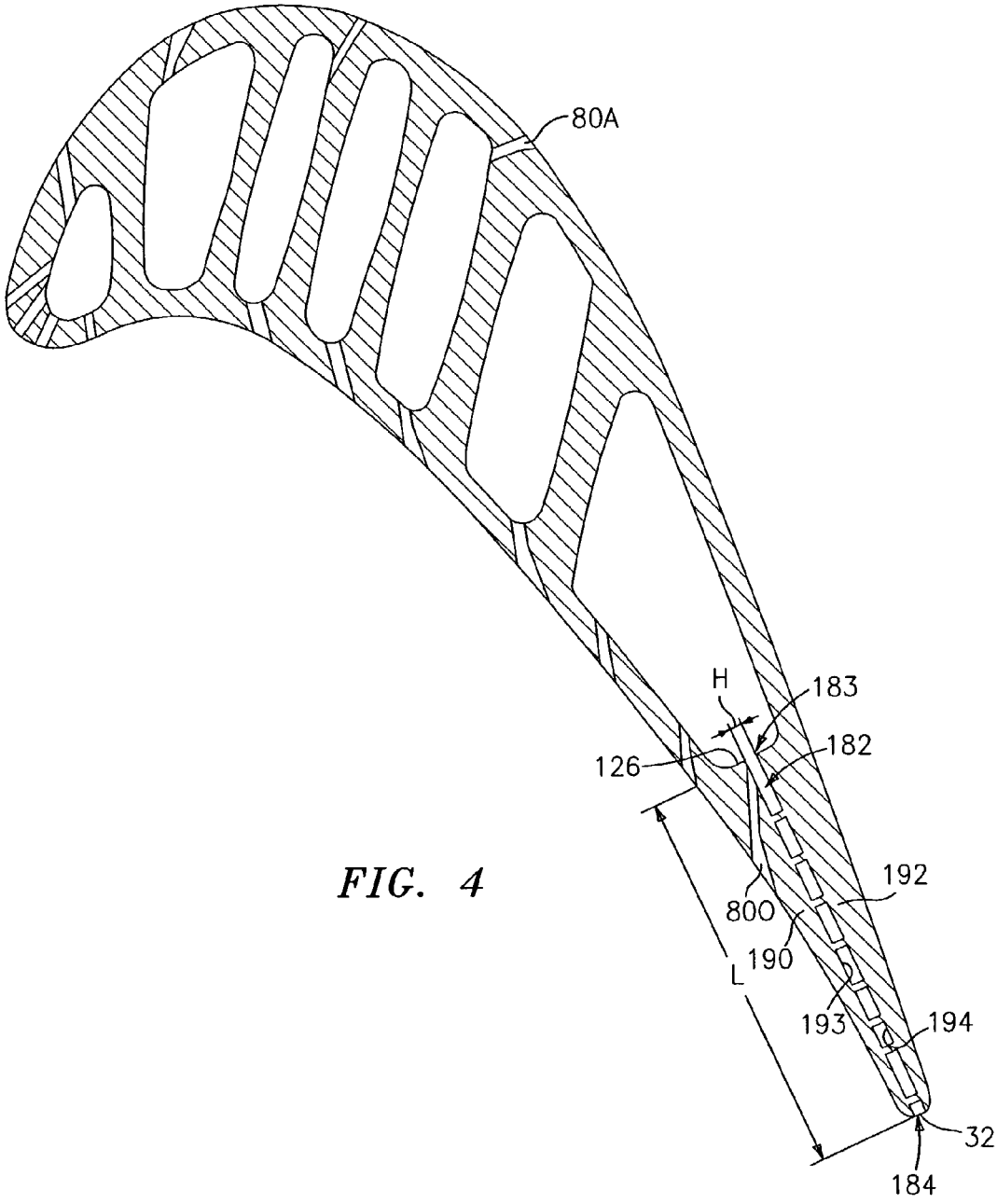
FIG. 4 is a sectional view of an airfoil of the blade of FIG. 1.

FIG. 4 shows the blade in a section taken to cut through pedestals of each row 132–146 for purposes of illustration. These pedestals are shown as formed within a slot 182 extending from an inlet 183 at the rear extremity 126 of trunk 122 to an outlet 184 at the trailing edge 32. The slot has a height H and an inlet-to-outlet length L. The slot locally separates wall portions 190 and 192 along the pressure and suction sides of the airfoil, respectively, having opposed facing parallel interior inboard surfaces 193 and 194. The slot extends from an inboard end 195 (FIG. 3) at the platform 26 to an outboard end 196 adjacent the tip 28.

Figure 5A:
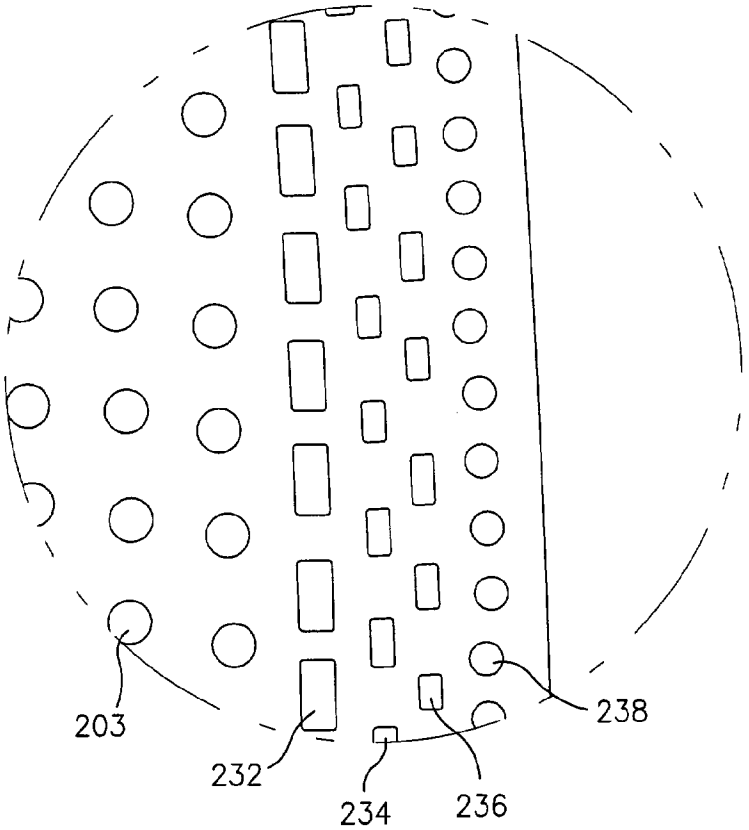
FIG. 5 is a top (suction side) view of an insert for forming the blade of FIG. 3.
Figure 5:
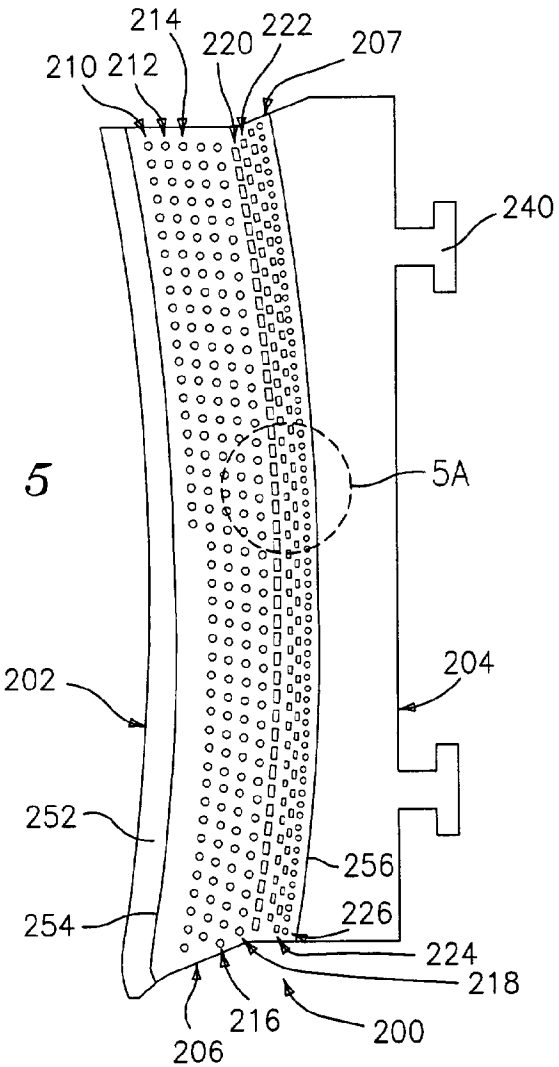
Figure 6:
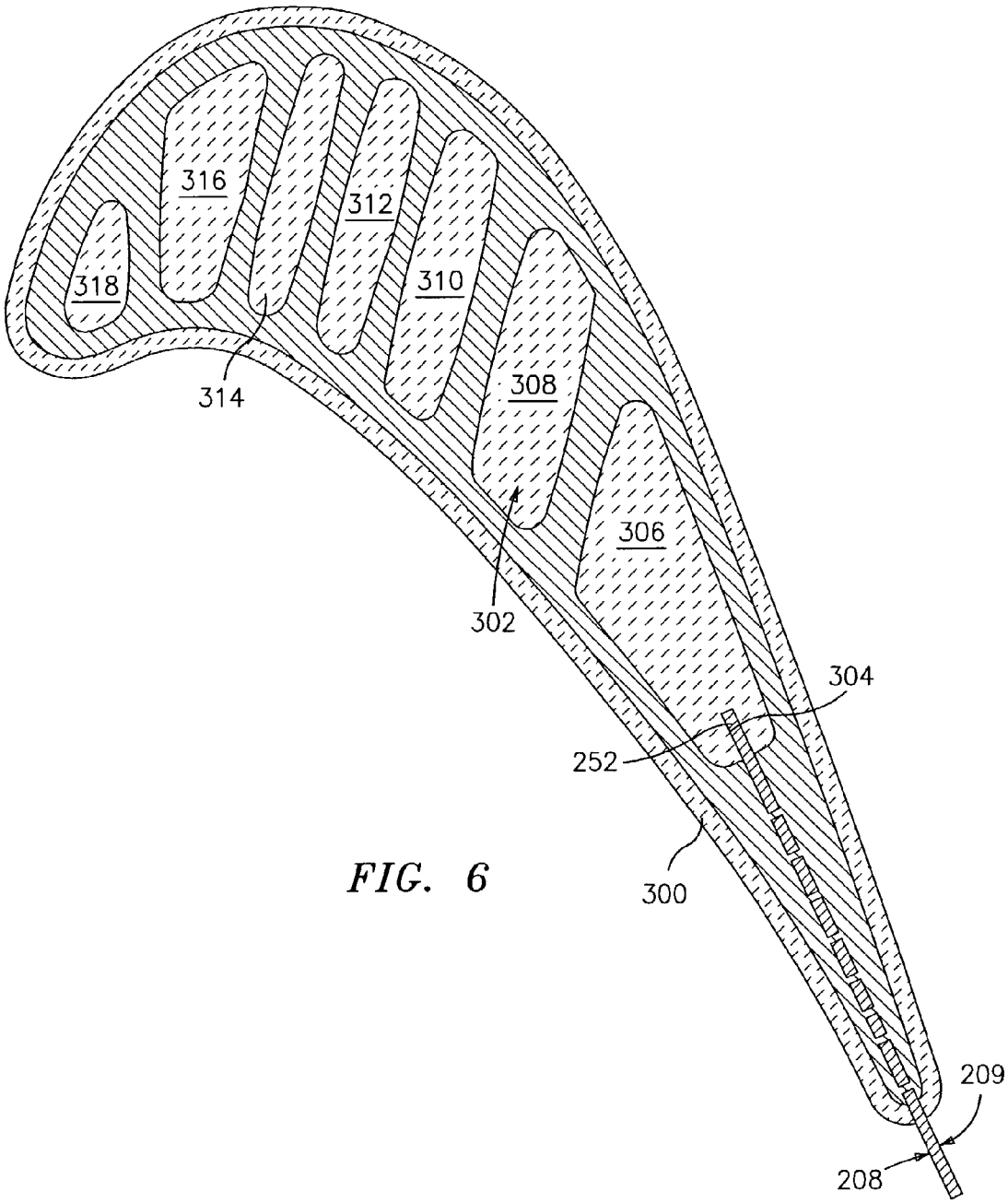
FIG. 6 is a sectional view of the blade of FIG. 3 during manufacture.

According to a preferred method of manufacture, the pedestals are formed by casting the blade over a thin sacrificial element assembled to a ceramic core. An exemplary sacrificial element is a metallic member (insert) partially inserted into a mating feature of the core. The insert may initially be formed from a refractory metal (e.g., molybdenum) sheet and then assembled to the ceramic core. FIG. 5 shows an insert 200 formed by machining a precursor sheet (e.g., via laser cutting/drilling). The insert has its own leading and trailing edges 202 and 204 and inboard and outboard ends 206 and 207. Central portions of the inboard and outboard ends 206 and 207 corresponded to and define the slot inboard and outboard ends 195 and 196. The insert has rows 210, 212, 214, 216, 218, 220, 222, 224, and 226 of apertures 230, 232, 234, 236, and 238 corresponding to and define the rows 130–146 of pedestals 160–168. FIG. 5 further shows the insert 200 as having a pair of handling tabs 240 extending from the trailing edge 204. A leading portion 252 is positioned to be inserted into a complementary slot in the ceramic core. For reference, a line 254 is added to designate the trailing boundary of this portion. Similarly, a line 256 shows the location of the trailing edge of the ultimate blade. FIG. 6 shows the blade in an intermediate stage of manufacture. The precursor of the blade is shown being cast in a sacrificial ceramic mold 300 around the assembly of the insert 200 and the ceramic core 302. The leading portion 252 of the insert is embedded in a slot 304 in a trailing portion 306 of the core that forms the aft supply cavity 48. Additional portions 308, 310, 312, 314, 316, and 318 of the core form the legs 60–63, the fore supply cavity 66, and the leading edge impingement cavity 72. Other portions (not shown) form the tip pocket and additional internal features of the blade of FIG. 3. Central portions of pressure and suction side surfaces 208 and 209 of the insert correspond to and define the pressure and suction side surfaces 193 and 194 of the slot and the bounding wall portions 190 and 192. After casting, the mold, core, and insert are destructively removed such as via chemical leaching. Thereafter the blade may be subject to further machining (including drilling of the film holes via laser, electrical discharge, or other means, and finish machining) and/or treatment (e.g., heat treatments, surface treatments, coatings, and the like).

Use of the insert may provide control over pedestal size, geometry, and positioning that might not be obtained economically, reliably and/or otherwise easily with only a single-piece ceramic core. An exemplary strip thickness and associated slot height H is 0.012 inch. In an exemplary dimensioning of the exemplary combination and arrangement of pedestals, the diameter $D_1$ is 0.025 inch and pitch $P_1$ is 0.060 inch leaving a space $S_1$ of 0.035 inch. The ratio of the pedestal dimension along the row ($D_1$) to the pitch defines a percentage of area along the row that is blocked by pedestals. For the identified dimensions this blockage factor is 41.7% for each row in the leading group of rows. The row pitch $R_1$ is 0.060 inch. The diameter $D_5$ is 0.020 inch and the pitch $P_5$ is 0.038 inch having a spacing $S_5$ of 0.018 inch and a blockage factor of 52.6%. The row pitch $R_5$ is 0.031 inch. The exemplary rounded rectangular pedestals have corner radii of 0.005 inch. The length $L_2$ is 0.04 inch, the width $W_2$ is 0.020 inch, and the pitch $P_2$ is 0.063 inch leaving a spacing $S_2$ of 0.023 inch for a blockage factor of 63.5%. The row pitch $R_2$ is 0.055 inch. The length $L_3$ is 0.025 inch, the width $W_3$ is 0.015 inch, and the pitch $P_3$ is 0.063 inch leaving a spacing $S_3$ of 0.038 inch for a blockage factor of 39.7%. The row pitch $R_3$ is 0.040 inch. The length $L_4$ is 0.025 inch, the width $W_4$ is 0.015 inch, and the pitch $P_4$ is 0.063 inch leaving a spacing $S_4$ of 0.038 inch for a blockage factor of 39.7%. The row pitch $R_4$ is 0.033 inch.

The shapes, dimensions, and arrangement of pedestals may be tailored to achieve desired heat flow properties including heat transfer. A combination of a relatively low blockage arrangement of pedestals over a forward area with relatively higher blockage in metering areas (rows) immediately aft thereof and near the trailing edge may be useful to achieve relatively higher heat transfer near the two metering rows. This concentration may occur with correspondingly less pressure drop than is associated with an impingement cavity, resulting in less thermal/mechanical stress and associated fatigue. The use of elongate pedestals for the first metering row (relative to a greater number of smaller pedestals producing a similar overall blockage factor) controls local flow velocity. The use of a relatively high number of non-elongate pedestals in the trailing metering row serves to minimize trailing wake turbulence. The presence of pedestals between the two metering rows having intermediate elongatedness serves to provide a progressive transition in wakes/turbulence between the two metering rows. The small spacing and high blockage factors associated with the trailing metering row also serves to accelerate the flow for an advantageous match of Mach numbers between the flow exiting the slot outlet and the flows over the pressure and suction sides. This is particularly advantageous where, as in the exemplary embodiment, the true trailing edge is aligned with the slot outlet rather than having an outlet well up the pressure side from the true trailing edge. The advantageous balance may involve a slot trailing edge Mach number of at least 50% of the Mach numbers on pressure and suction sides (e.g., a slot trailing edge Mach number of 0.45–0.55 when the pressure or suction side Mach number is 0.8). The gap 180 aft of the trailing row of pedestals serves to further permit diffusing of the wakes ahead of the slot outlet. This may reduce chances of oxidation associated with combustion gases being trapped in the wakes. For this purpose, the gaps may advantageously be at least the dimension along the row of the trailing pedestals ($D_5$). A broader range is in excess of 1.5 times this dimension and a particular range is 1.5–2.0 times this dimension.

By using a relatively smaller number of relatively larger diameter circular pedestals for the leading group than for the trailing metering row, less heat transfer is incurred over this leading section where it is not as greatly required. The use of relatively large diameter pedestals at a given density provides greater structural integrity.

One or more embodiments of the present invention have been described. Nevertheless, it will be understood that various modifications may be made without departing from the spirit and scope of the invention. For example, details of the turbine element exterior contour and environment may influence cooling needs and any particular implementation of the invention. When applied as a redesign or reengineering of an existing element, features of the existing element may constrain or influence features of the implementation. Accordingly, other embodiments are within the scope of the following claims.

What is claimed is:

1. A turbine element comprising:

a platform; and an airfoil:

extending along a length from a first end at the platform to a second end;

having a leading and trailing edges and pressure and suction sides; and having a cooling passageway network, wherein the cooling passageway network includes:

a trailing passageway;

a slot extending from the trailing passageway toward the trailing edge and locally separating pressure and suction sidewall portions of the airfoil and having opposed first and second slot surfaces, the exact trailing edge of the airfoil falling along an outlet of the slot; and a plurality of discrete posts spanning the slot between the pressure and suction sidewall portions.

2. The element of claim 1 wherein to posts have dimensions along the slot no greater than 0.10 inch.

3. The element of claim 1 wherein to second end is a free tip.

4. The element of claim 1 wherein the plurality of posts includes:

leading group of posts;

a first metering row of posts trailing the leading group and having a greater restriction factor than a restriction factor of the leading group;

a second metering row of posts trailing the first metering row and having a restriction factor greater than the restriction factor of to leading group; and at least one intervening group between the first and second metering rows having a restriction factor less than the restriction factors of the first and second metering rows.

5. The element of claim 1 wherein the plurality of posts includes a trailing array of posts spaced ahead of an outlet of the slot.

6. The element of claim 1 wherein the blade consists essentially of a nickel alloy.

7. The element of claim 1 wherein the plurality of posts includes:

a leading group of a plurality of rows of posts having essentially circular sections;

a trailing row of posts having essentially circular sections; and a plurality of intervening rows of posts having sections elongate the direction of their associated rows.

8. A turbine element comprising:

a platform; and an airfoil:

extending along a length from a first end at the platform to a second end;

having a leading and trailing edges and pressure and suction sides; and having a cooling passageway network, wherein the cooling passageway network includes:

a trailing passageway, a slot extending from the trailing passageway toward the trailing edge and locally separating pressure and suction sidewall portions of the airfoil and having opposed first and second slot surfaces; and means in the slot for providing a generally progressively rearwardly increasing heat transfer coefficient over a first area, a first peak heat transfer coefficient at a first location aft of said first area, a second peak heat transfer coefficient less than the first peak heat transfer coefficient at a second location aft of the first location, and a local trough in heat transfer coefficient between said first and second locations.

9. The element of claim 8 wherein means comprises a plurality of posts having dimensions along the slot no greater than 0.10 inch.

10. A turbine element-forming core assembly comprising:

at least one ceramic element having a plurality of portions for at least partially defining associated legs of a conduit network within the turbine element; and at least one refractory metal sheet secured to the at least one ceramic element positioned extending aft of a trailing one of the plurality of portions and having:

opposed first and second surfaces; and a plurality of apertures extending between the first and second surfaces for forming associated posts between pressure and suction side portions of an airfoil of the turbine element.

11. The core assembly of claim 10 wherein the plurality of apertures include:

at least one row of circular apertures; and at least one row of elongate apertures, elongate substantially in the direction of their row.

12. The core assembly of claim 10 wherein the plurality of apertures include:

a plurality of rows of circular apertures; and a plurality of rows of elongate apertures, elongate substantially in the direction of their rows.

13. The core assembly of claim 12 wherein at least some of the elongate apertures are substantially rectangular.

14. The core assembly of claim 10 wherein the plurality of apertures includes a plurality of arcuate rows of said apertures.

15. The core assembly of claim 10 wherein:

the plurality of apertures are arranged in a plurality of rows;

in a first subplurality of the plurality of rows, the apertures in each row essentially have a characteristic width and a greater characteristic separation; and in at least a first metering row of the plurality of rows, trailing the first subplurality the apertures in each row essentially have a characteristic width and a lesser characteristic separation.

16. The core assembly of claim 10 in combination with a mold and wherein pressure and suction side leading meeting locations of the mold and the refractory metal sheet fall along essentially unapertured portions of said sheet.

17. A method for manufacturing a turbine blade, comprising:

assembling at least one ceramic core and apertured refractory metal sheet;

forming a mold around the ceramic core and refractory metal sheet, wherein:

the mold has surfaces substantially defining:

a blade platform;

an airfoil:

extending along a length from a root at the platform to a tip; and having leading and trailing edges separating pressure and suction sides; and the assembled ceramic core and refractory metal sheet have surfaces for forming a cooling passageway network through the airfoil;

introducing a molten alloy to the mold;

allowing the alloy to solidify to initially form the blade;

removing the mold; and destructively removing the assembled ceramic core and refractory metal sheet.

18. The method of claim 17 further comprising:

drilling a plurality of holes in the blade for farther forming the cooling passageway network.

19. The method of claim 17 further comprising:

laser drilling a plurality of holes in the refractory metal sheet prior to assembling it with the ceramic core.

20. The method of claim 17 wherein:

the refractory metal sheet forms a trailing edge slot having an outlet along an exact trailing edge of the blade.

21. A turbine element comprising:

a platform; and an airfoil:

extending along a length from a first end at the platform to a second end;

having a leading and trailing edges and pressure and suction sides; and having a cooling passageway network, wherein the cooling passageway network includes:

a trailing passageway;

a slot extending from the trailing passageway toward the trailing edge and locally separating pressure and suction sidewall portions of the airfoil and having opposed first and second slot surfaces; and a plurality of discrete posts spanning the slot between the pressure and suction sidewall portions, the plurality of posts including:

leading group of posts;

a first metering row of posts trailing the leading group and having a greater restriction factor than a restriction factor of the leading group;

a second metering row of posts wailing the first metering row and having a restriction factor greater than the restriction factor of the leading group; and at least one intervening group between the first and second metering rows having a restriction factor less than the restriction factors of the first and second metering rows.

22. The element of claim 21 being a blade wherein the second end is a free tip.

23. The clement of claim 5 wherein the trailing array of posts have a characteristic transverse dimension and are spaced ahead of the outlet of the slot by at least said characteristic transverse dimension.

24. The element of claim 5 wherein the trailing array of posts have a circular cross-section.

25. The element of claim 5 wherein the trailing array of posts have a characteristic transverse dimension and are spaced ahead of the outlet of the slot by 1.5–2.0 times said characteristic transverse dimension.

26. The element of claim 5 wherein the trailing array of posts are spaced ahead of the outlet of the slot by at least 0.020 inch.

27. The element of claim 5 wherein the Wailing array of posts are spaced ahead of the outlet of the slot by 0.020–0.040 inch.

28. A turbine element comprising:

a platform; and an airfoil:

extending along a length from a first end at the platform to a second end;

having a leading and trailing edges and pressure and suction sides; and having a cooling passageway network, wherein the cooling passageway network includes:

a trailing passageway;

a slot extending from the trailing passageway toward the trailing edge and locally separating pressure and suction sidewall portions of the airfoil and having opposed first and second slot surfaces; and a plurality of discrete posts spanning the slot between the pressure and suction sidewall portions, the plurality of posts including:

a leading group of a plurality of rows of posts having essentially circular sections;

a trailing row of posts having essentially circular sections; and a plurality of intervening rows of posts having sections elongate the direction of their associated rows.

29. The element of claim 28 being a blade wherein the second end is a free tip.

30. A turbine element comprising:

a platform; and an airfoil:

extending along a length from a first end at the platform to a second end;

having a leading and tailing edges and pressure and suction sides; and having a cooling passageway network, wherein the cooling passageway network includes:

a trailing passageway;

a slot extending from the Wailing passageway toward the trailing edge and locally separating pressure and suction sidewall portions of the airfoil and having opposed first and second slot surfaces; and a plurality of discrete posts spanning the slot between the pressure and suction sidewall portions, the plurality of posts including:

a plurality of first posts; and a plurality of second posts, between the plurality of first posts and the trailing edge, the second posts having a smaller cross-section than the first posts.

31. The element of claim 30 further comprising:

a plurality of third posts between the plurality of first posts and the plurality of second posts and having transversely elongate cross-sections.

32. A turbine element comprising:

a platform; and an airfoil:

extending along a length from a first end at the platform to a second end;

having a leading and trailing edges and pressure and suction sides; and having a cooling passageway network, wherein the cooling passageway network includes:

a trailing passageway;

a slot extending from the trailing passageway toward the trailing edge and locally separating pressure and suction sidewall portions of the airfoil and having opposed first and second slot surfaces; and means for:

providing at least first and second relatively high heat transfer locations;

providing a progressive transition in wakes and turbulence between the first and second relatively high heat transfer locations; and permitting diffusion of the wakes ahead of a slot outlet.

33. The element of claim 32 operating so as to provide:

a slot trailing edge Mach number of at least 50% of Mach numbers on each of the pressure and suction sides.

34. A turbine blade comprising:

a platform; and an airfoil:

extending along a length from a first end at the platform to a second end;

having a leading and trailing edges and pressure and suction sides; and having a cooling passageway network, wherein the cooling passageway network includes:

a tailing passageway;

a slot extending from the trailing passageway toward the trailing edge and locally separating pressure and suction sidewall portions of the airfoil and having opposed first and second slot surfaces; and a plurality of discrete posts spanning the slot between the pressure and suction sidewall portions and including at least first and second rows of said posts, phases of said first and second rows partially, but not fully staggered so that adjacent posts are approximately out of phase when viewed along an overall flow direction, said overall flaw direction reflecting influence of centrifugal action.

* * * * *

UNITED STATES PATENT AND TRADEMARK OFFICE

CERTIFICATE OF CORRECTION

PATENT NO. : 7,014,424 B2
APPLICATION NO. : 10/409521
DATED : March 21, 2006
INVENTOR(S) : Frank J. Cunha et al.

It is certified that error appears in the above-identified patent and that said Letters Patent is hereby corrected as shown below:

In column 7, claim 3, line 36, “to” should read --the--.

In column 7, claim 4, line 46, “to” should read --the--.

In column 8, claim 8, line 7, after “passageway”, delete the “,” and insert a --;--.

In column 8, claim 15, line 57, after “subplurality” insert a --,--.

In column 9, claim 18, line 19, “farther” should read --further--.

In column 9, claim 21, line 49, “wailing” should read --trailing--.

In column 10, claim 27, line 4, “Wailing” should read --trailing--.

In column 10, claim 30, line 42, “Wailing” should read --trailing--.

In column 12, claim 34, line 16, “flaw” should read --flow--.

Signed and Sealed this

First Day of May, 2007

JON W. DUDAS
*Director of the United States Patent and Trademark Office*